US006600384B2

(12) United States Patent
Mohwinkel et al.

(10) Patent No.: US 6,600,384 B2
(45) Date of Patent: Jul. 29, 2003

(54) IMPEDANCE-COMPENSATING CIRCUIT

(75) Inventors: Clifford A. Mohwinkel, San Jose, CA (US); Mark J. Vaughan, San Jose, CA (US)

(73) Assignee: Endwave Corporation, Sunnyvale, CA (US)

( * ) Notice: Subject to any disclaimer, the term of this patent is extended or adjusted under 35 U.S.C. 154(b) by 34 days.

(21) Appl. No.: 09/861,063

(22) Filed: May 18, 2001

(65) Prior Publication Data

US 2002/0175777 A1 Nov. 28, 2002

(51) Int. Cl.[7] ..... H01P 1/24
(52) U.S. Cl. ..... 333/22 R; 333/32
(58) Field of Search ..... 333/22 R, 32

(56) References Cited

U.S. PATENT DOCUMENTS

| | | | | |
|---|---|---|---|---|
| 3,516,024 A | * | 6/1970 | Lange | 333/116 |
| 3,895,435 A | | 7/1975 | Turner et al. | 29/625 |
| 4,413,241 A | | 11/1983 | Bitoune et al. | 333/22 R |
| 5,130,677 A | * | 7/1992 | Takai | 333/22 R |
| 5,424,693 A | | 6/1995 | Lin | 333/33 |
| 5,693,595 A | | 12/1997 | Talisa et al. | 505/210 |
| 5,768,109 A | | 6/1998 | Gulick et al. | 361/794 |
| 6,198,362 B1 | * | 3/2001 | Harada et al. | 333/12 |

OTHER PUBLICATIONS

Pearson, S.I. and Maler, G.J.,*Introductory Circuit Analysis*, (John Wiley & Sons, Inc., New York) 1965, pp. 490–497.
Van Valkenburg, M. E.,*Network Analysis, third Edition*, (Prentice–Hall, Englewood Cliffs, New Jersey) 1955, pp. 81–82.
Arai, Y., Sato, M., Yamada, H. T., Hamada, T., Nagaik., and Fujishiro, H. I., "60GHz Flip–Chip Assembled MIC Design Considering Chip–Substrate Effect",*IEEE MTT–S Digest*, pp. 447–450, 1997.

* cited by examiner

*Primary Examiner*—Robert Pascal
*Assistant Examiner*—Stephen E. Jones
(74) *Attorney, Agent, or Firm*—Kolisch Hartwell, P.C.

(57) ABSTRACT

A via termination for a microstrip transmission line formed on a substrate includes a termination resistor that connects an end of the signal conductor to a backside ground plane through a via. Two open-circuit stubs are also formed on the first face of the substrate, one stub on each side of the termination resistor. A compensation resistor on the first face of the substrate connects the end of the signal conductor to each open-circuit stub. The load resistor is equal to the characteristic impedance of the transmission line and the compensation resistors are each equal to twice the characteristic impedance. The combined termination ideally exhibits a real impedance equal to the characteristic impedance over a wide frequency range.

15 Claims, 3 Drawing Sheets

IMPEDANCE-COMPENSATING CIRCUIT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to circuits providing impedance compensation over a frequency range, and in particular, a circuit having a pair of impedance circuits connected between first and second circuit terminals, each impedance circuit having resistance and frequency-responsive components. In its preferred form, the invention relates to terminations for transmission lines having a conventional termination and compensation for the conventional termination.

At radio frequencies, uniform transmission lines, such as microstrip lines and coplanar transmission lines, exhibit a characteristic impedance. Line terminations are used in certain circuits, such as directional couplers. A termination is provided by applying a resistive load at the end of the line, which load is equal in magnitude to the magnitude of the characteristic impedance. This is usually in the form of a thin film deposited resistor made on an insulating substrate on which a signal conductor of the line is formed. The resistive load couples the end of the signal conductor to a ground conductor.

The resistive load, when connected to ground, has a reactance component. Typically this reactance component is predominantly inductive at radio frequencies. This results in an impedance mismatch between the transmission line and the resistive load termination. It is known to compensate for the inductive reactance component by adding shunt capacitance to the resistive load, as disclosed in U.S. Pat. No. 4,413,241. Such a design provides a reasonably well-matched termination at a design frequency although the resistance of the termination is increased with the addition of the capacitance. However, for frequencies varying from the design frequency, it is desirable to have a termination having a real part that is equal to the characteristic impedance of a line being terminated and having a very low reactive component.

BRIEF SUMMARY OF THE INVENTION

The present invention is directed to a circuit that provides impedance compensation and, in its preferred form, provides compensated impedance for broadband applications. It includes a first impedance circuit having a first resistance device connected to a first impedance device. A second impedance circuit includes a second resistance device connected to a second impedance device. The first and second impedance circuits couple first and second circuit terminals. The product of the impedances of the first and second impedance devices is preferably substantially equal to the product of the resistances of the first and second resistance devices.

As used herein, an impedance circuit or device is any circuit component or circuit of components that provide impedance to a signal. Typical examples of circuit components include resistors, capacitors and inductors, but may also include other devices, such as transmission lines, stubs, vias, and active devices that add resistance, capacitance or inductance to the circuit. Such components may provide a combination of impedance types, such as inductance and resistance, and are typically distributed impedances at high frequencies. An impedance of a circuit element is considered to be distributed when it exists along a dimension of the circuit element, such as inductance along the length of a transmission line.

In the preferred embodiment, the invention provides a termination circuit for a microstrip transmission line including a strip signal conductor on the first face of a substrate and a ground plane on the second face of the substrate. A first termination or load resistor is coupled to ground through a short-circuit transmission line in the form of a via. The via extends through the substrate between the first face of the substrate and the ground plane. An open-circuit stub is formed on the first face of the substrate to compensate for the via. A second resistor couples the end of the signal conductor to the open-circuit stub. The first and second resistors are each equal to the characteristic impedance of the line. As will be seen, the product of the impedances of the open-circuit stub and the via is substantially equal to the square of the resistances of the first and second resistors.

The open-circuit stub exhibits primarily a capacitive impedance in the series circuit with the second resistor. The stub thus compensates for the parasitic inductance due to the line length of the via, particularly at higher frequencies.

Further, at a known frequency, the magnitude of the impedance of the stub is preferably set to be equal to the magnitude of the impedance of the via, which impedances are also equal to the values of the resistors. At lower frequencies the capacitive impedance of the stub increases and the inductive impedance of the via decreases. The reverse is true for higher frequencies. The total impedance for the combined termination thus stays relatively constant and real (resistive) over a wide frequency range.

A termination according to the invention is particularly useful in a directional coupler, such as is used in a balanced amplifier.

In a modified version of the invention, the first resistance device is connected in parallel with the second impedance device, and the second resistance device is connected in parallel with the first impedance device. This embodiment is particularly useful in applications in which a terminated device exhibits high impedance.

These and other features and advantages of the present invention will be apparent from the preferred embodiment described in the following detailed description and illustrated in the accompanying drawings.

DETAILED DESCRIPTION OF THE PREFERRED EMBODIMENT OF THE INVENTION

Figure 1:
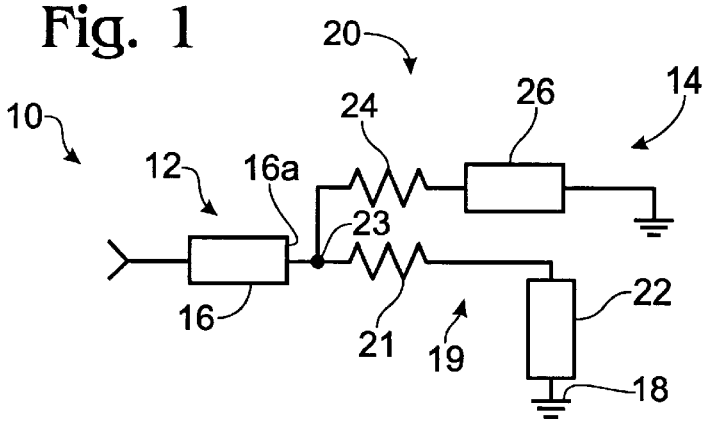
FIG. 1 is a general circuit diagram of a termination made according to the preferred embodiment of the invention on an end of a transmission line.

As has been mentioned, the invention provides for a circuit having impedance compensation for broadband applications. The preferred embodiment of the invention is a transmission line termination having two parallel impedance circuits connected to the end of a transmission line. FIG. 1 is a circuit diagram of a preferred termination circuit 10 including a transmission line 12 and a termination 14 coupling a signal line 16 of the transmission line to a ground conductor 18. Termination 14, also referred to as a circuit providing impedance compensation, includes a first termination impedance circuit 19 and a parallel second termination impedance circuit 20. In the general sense, termination circuit 14 couples a first circuit terminal 23 to a second circuit terminal 18. Impedance circuit 19 includes a first load resistance device 21 preferably having a resistance equal to the characteristic impedance of the transmission line, which is typically 50 ohms. Resistance device 21 connects a terminal 23 associated with an end 16*a* of the transmission line to ground 18 through a ground connector or impedance device 22.

Impedance circuit 20 includes a second load resistance device 24 in series with an impedance device 26. Devices 24 and 26 compensate for the impedance in the termination impedance circuit 19 provided by devices 21 and 22. The resistance of resistance device 24 is preferably substantially equal to the resistance of resistance device 21.

Impedance circuit 19 or impedance circuit 20 may be in the form of a single device. For instance a strip resistor may have sufficient length that it produces significant inductance or capacitance at certain frequencies. The reference to these impedance circuits as individual components in series or parallel configuration is therefore intended to encompass situations in which the electrical components are provided by a single device such as a discrete component or one providing distributed impedance. As is well known, a network of devices may also provide an equivalent electrical effect.

In the preferred embodiment transmission line 12 is a microstrip line having a characteristic impedance, $Z_O$=50 ohms, resistance devices 21 and 24 are resistors, $R_1$ and $R_2$=50 ohms, impedance device 22, $Z_1$, is a short-circuit stub in the form of a via, and impedance device 26, $Z_2$, is preferably an open-circuit stub. Ground via 22 has primarily an inductive impedance. The open circuit stub 26 has a capacitive impedance. As discussed below, $R_2$ and $Z_2$ are selected so that the termination circuit ideally has an impedance equal to $R_1$ for all frequencies.

The input impedance, $Z_{in}$, of termination circuit 14 at terminal 23 is $$Z_{in}=(R_1+Z_1)\|(R_2+Z_2), \tag{1}$$

where the symbol || indicates that the series circuit $R_1+Z_1$ is in parallel with the series circuit $R_2+Z_2$, $$= \frac{(R_1+Z_1)(R_2+Z_2)}{R_1+Z_1+R_2+Z_2}$$

$$= \frac{R_1R_2+R_1Z_2+R_2Z_1+Z_1Z_2}{R_1+R_2+Z_1+Z_2}$$

-continued $$= \frac{R_1\left(R_2+Z_2+\frac{R_2Z_1}{R_1}+\frac{Z_1Z_2}{R_1}\right)}{R_1+R_2+Z_1+Z_2}$$

In the general case, then, $Z_{in}=R_1$ for all frequencies when $$\frac{R_2Z_1}{R_1}+\frac{Z_1Z_2}{R_1}=R_1+Z_1.$$

In the preferred embodiment, $R_1=R_2=R$, in which case, $$Z_1+\frac{Z_1Z_2}{R}=R+Z_1.$$

Simplifying, $$Z_1Z_2=R^2. \tag{2}$$

When this condition is met, then ideally for all frequencies $Z_{in}$=R. It will be appreciated that this is an ideal result. The resistors $R_1$ and $R_2$ represent the sum of the real portion of the impedances, whether distributed or discrete, in the two arms of the termination circuit. In order to realize a 50-ohm termination for a 50-ohm transmission line, the values of the resistances of $R_1$ and $R_2$ are also preferably equal to 50 ohms. Further, since most high frequency applications only require operation over an octave or decade bandwidth, it is sufficient for the circuit to function substantially with the desired effect over that bandwidth.

Figure 2:
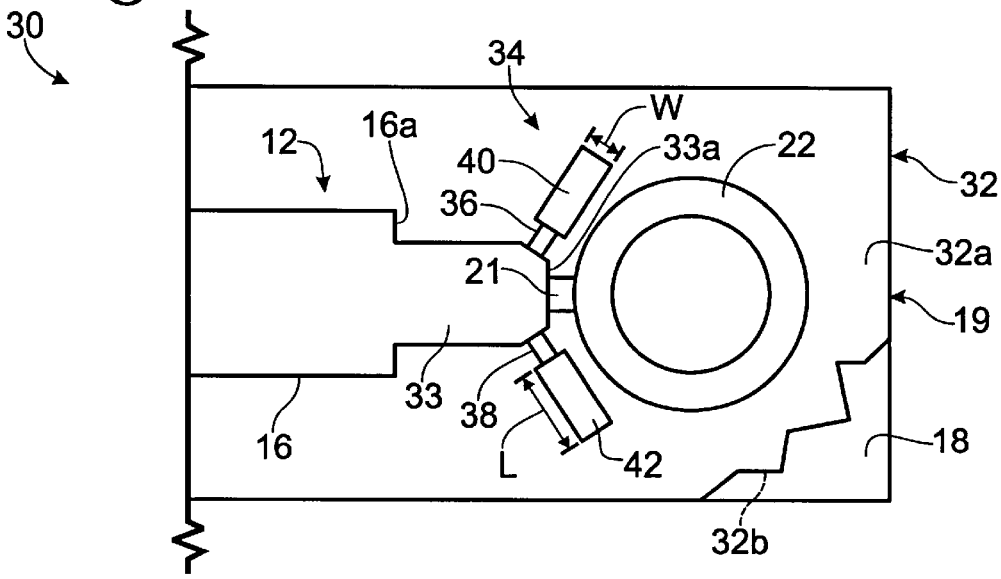
FIG. 2 is a top view of a preferred embodiment of the circuit of FIG. 1.

Referring now to FIG. 2, a preferred microstrip impedance-compensating circuit 30 is shown. Components that are equivalent to the structure illustrated in FIG. 1 are assigned the same reference numbers. This includes transmission line 12 having a signal line 16 and a backside ground plane 18 formed on opposite faces 32*a* and 32*b* of an insulating substrate 32, formed of 10 mil alumina. Face 32*b* is hidden from view in the figure. An impedance-matching section 33 of reduced width couples an end 16*a* of the signal line to end 33*a* of the impedance-matching section. End 33*a* corresponds to terminal 23 shown in FIG. 1. Impedance matching section 33 transforms the impedance between the transmission line and the impedance-compensating portion of the circuit described below. In this embodiment, section 33 provides reactive impedance to transformation. Other parasitics in impedance compensating circuit 34 can also be compensated by impedance matching section 33. Substrate 32 and via 22 are constructed according to the intended use of the termination.

Circuit 30 also includes a termination circuit 34, composed of a resistance in the form of a first load resistor 21 in series with via 22. Instead of a single second resistor for resistance device 24, the equivalent of resistance device 24 is formed by symmetrically opposed second and third resistors 36 and 38 of 100 ohms each, having one end connected to conductor end 16*a*. Similarly, stub 26 is replaced by two corresponding impedance devices in the form of open-circuit stubs 40 and 42, connected respectively, as shown, to the outer ends of resistors 36 and 38. The two stubs have a length, L, of 5 mils and a width, W, of 2.5 mils. The length is equivalent to about one thirtieth of the wavelength at the highest design frequency. Here the compensation leg shown in FIG. 1 is separated into two portions, each with double impedance devices.

Proof of the effectiveness of an open circuit transmission line stub as compensation for a shorted transmission line, embodied as a via in the preferred embodiment, is shown in the following analysis. The input impedance $Z_i$ of a length of ideal transmission line having a characteristic impedance $Z_0$, a length l and propagation constant β terminated by a load impedance device $Z_L$ is given by:

$$Z_i = Z_0 \frac{Z_L \cos\beta l + jZ_0 \sin\beta l}{Z_0 \cos\beta l + jZ_L \sin\beta l} \tag{3}$$

Specific cases are the shorted line ($Z_L$=0) and the open line ($Z_L$=∞). The input impedance of a shorted line is found to be:

$$Z_{is} = Z_0 j \tan \beta l. \tag{4}$$

That for the open line is:

$$Z_{io} = \frac{Z_0}{j\tan\beta l}. \tag{5}$$

Thus, by multiplying, $Z_{is}$ and $Z_{io}$ are related by the expression:

$$Z_{is} Z_{io} = \frac{Z_0}{j\tan\beta l} \cdot Z_o j\tan\beta l = Z_0^2, \tag{6}$$

for any line length.

It is seen then that the circuit shown in FIG. 2, having these open and short circuit transmission lines, satisfies the criterion of equation (2), i.e., $Z_1Z_2=R^2$, and therefore is a constant impedance termination circuit.

Figure 3:
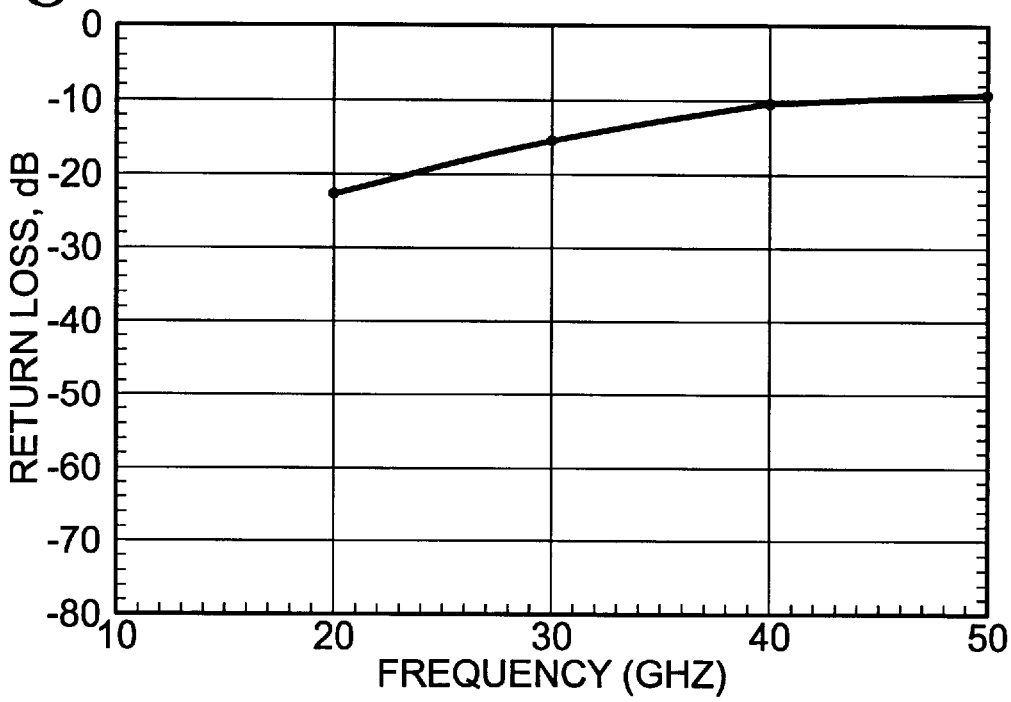
FIG. 3 is a graph of the return loss of a conventional microstrip via termination.

FIG. 3 is a graph showing the return loss of a conventional microstrip termination equivalent to a microstrip line terminated only by a load resistor connected to the via. It is seen that the resistor and via give 11 dB of return loss at 40 GHz and less than 25 dB of return loss for the range of 20 to 50 GHz.

Figure 4:
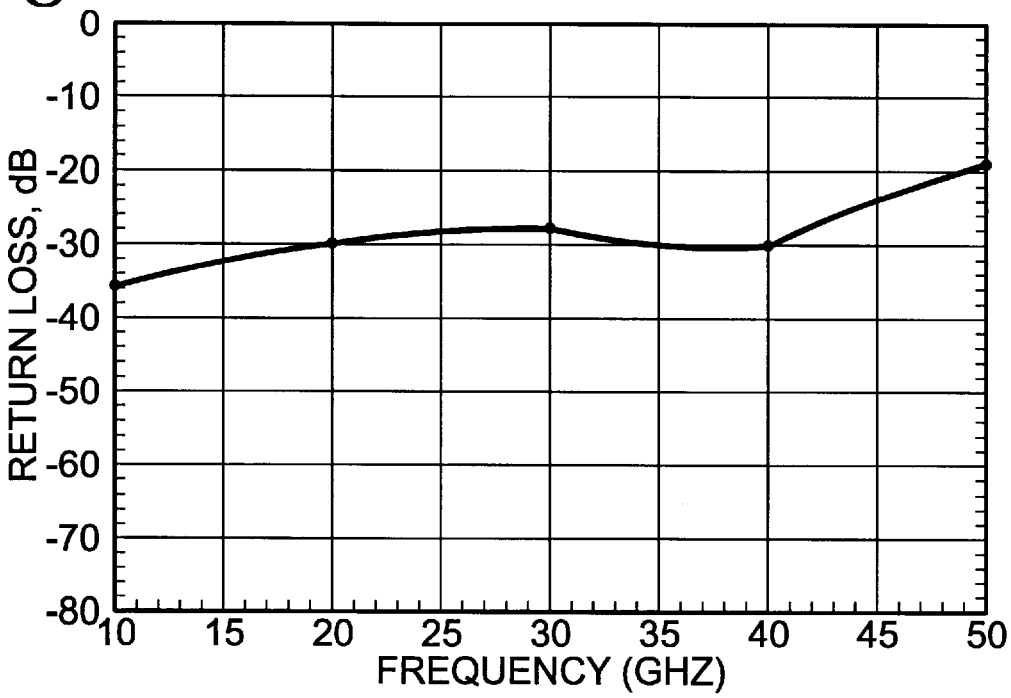
FIG. 4 is a graph of the return loss of the termination shown in FIG. 2.

FIG. 4 shows the return loss for the termination of FIG. 2. At 40 GHz the return loss is 30 dB and the return loss is more than about 20 dB for the illustrated frequency range of 10 to 50 GHz. It is thus seen that a termination made according to the invention provides a substantial improvement in return loss over an uncompensated microstrip via termination.

Figure 5:
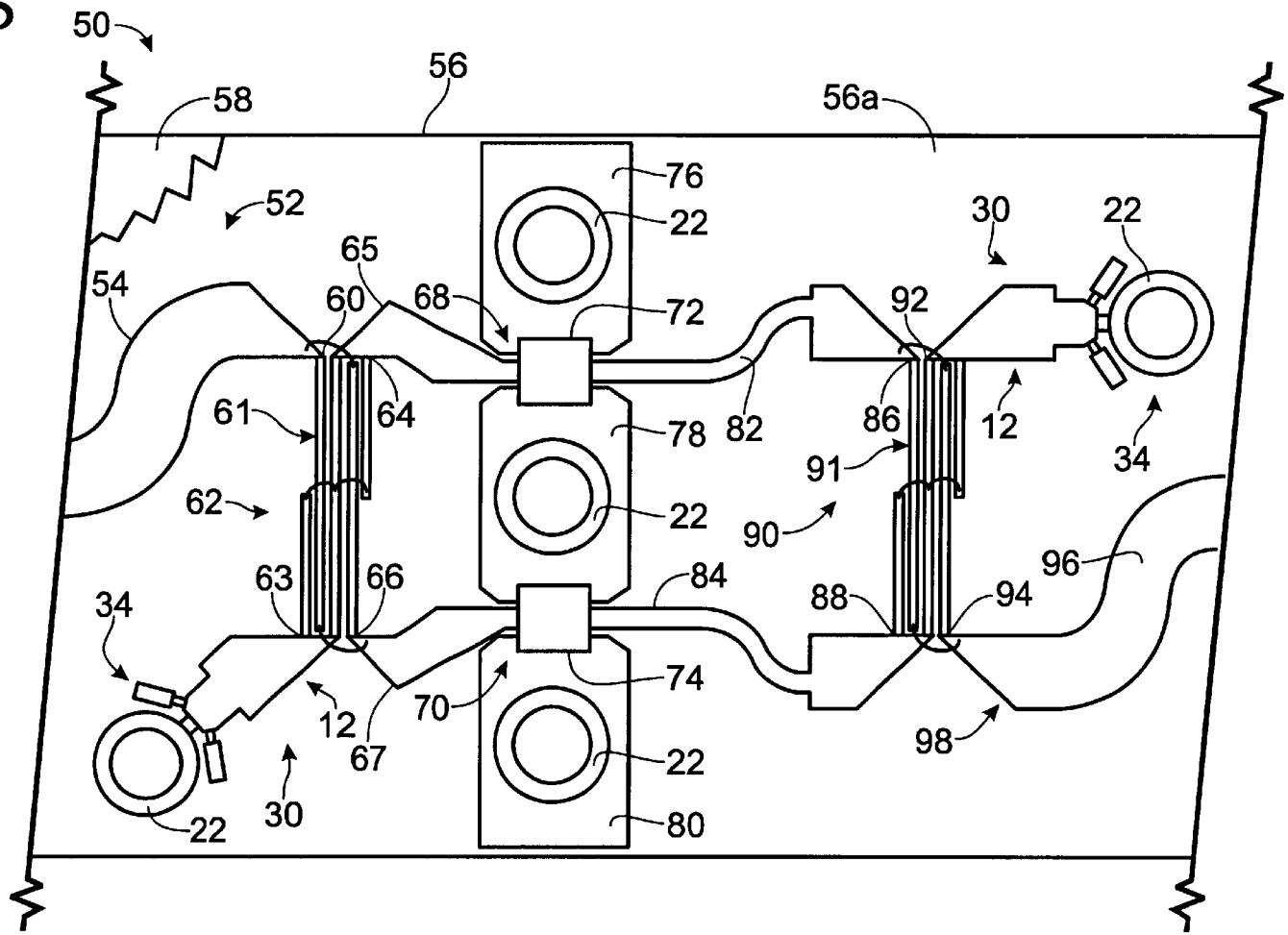
FIG. 5 is a top view of a balanced amplifier having the termination of FIG. 2.

FIG. 5 illustrates a plan view of a balanced amplifier 50 made according to the invention. Amplifier 50 includes an input microstrip line 52 having a strip signal conductor 54 formed on the top face 56*a* of an insulating substrate 56. A ground plane 58 is formed on the backside of the substrate. Input conductor 54 is connected to an input port 60 of a 3 dB directional, Lange coupler 62. A termination circuit 30 as illustrated in FIG. 2 is connected to a termination port 63. Interdigitated and coupled elements, shown generally at 61 and also referred to as coupling means, couple a signal on input port 60 to output ports 64 and 66.

The output ports are connected by active-device-input conductors 65 and 67 to the input terminals, not shown, of respective active devices 68 and 70 formed in integrated circuit chips 72 and 74. The chips are flip-mounted onto the associated conductors, as shown. Ground contacts for the chips are provided by ground conductors 76, 78 and 80, each of which is connected to backside ground plane 58 by vias 22 similar to the vias used in termination 34.

Active-device-output conductors 82 and 84, connect respective chips 72 and 74 to input ports 86 and 88 of an output Lange coupler 90 having interdigitated elements shown collectively at 91. As with coupler 62, a termination port 92 of the coupler is connected to a termination circuit 30. An output port 94 is connected to a signal conductor 96 of an output microstrip line 98. Conductors 54, 65, 67, 82, 84 and 96 are also referred to as signal lines.

Balanced amplifier 50 and couplers 62 and 90 exhibit improved performance through the use of termination circuits 30 made according to the invention. It will be appreciated that termination circuit 30 has two identical parallel circuit paths in addition to the traditional third termination path, with each of the first two paths having an impedance in which the magnitudes of the real and imaginary components at the design frequency are equal to twice the characteristic impedance. These two parallel paths are equivalent to a single parallel path with an impedance in which the magnitudes of the real and imaginary components at the design frequency are equal to the characteristic impedance. At frequencies above and below the design frequency, one of the single parallel equivalent path and the traditional termination path has higher reactance and the other has lower reactance, resulting in a net impedance for the termination approximately equal to the characteristic impedance. It is seen, then, that termination 30 is functional over a much wider frequency range than is a conventional termination.

Figure 6:
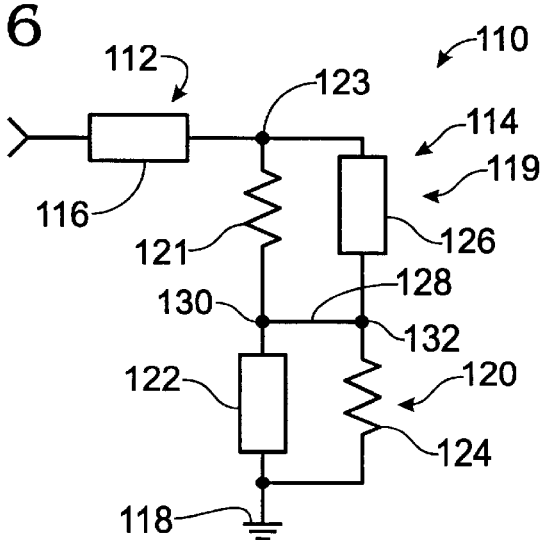
FIG. 6 is a general circuit diagram showing a modification of the circuit diagram of FIG. 1.

FIG. 6 illustrates a modification to the circuit of FIG. 1. A termination circuit 110 includes a transmission line 112 and a termination 114 coupling a signal line 116 of the transmission line to a ground conductor 118. Termination 114 includes a first termination impedance circuit 119 and a second termination impedance circuit 120 in series with the first. The two impedance circuits 119 and 120 generally connect a first terminal 123 associated with the end of the transmission line to ground 118. Ground 118 is also referred to as a second circuit terminal.

Impedance circuit 119 includes a load resistance device 121 in parallel with an impedance device 126. Impedance circuit 120 includes a load resistance device 124 in parallel with an impedance device 122. Devices 122 and 124 compensate for the impedance in impedance device 126. Devices 121 and 124 are also respectively referred to as first and second resistance devices, and devices 122 and 126 are also respectively referred to as first and second impedance devices.

If $R_1$, $R_2$, $Z_1$, and $Z_2$ are the impedances, respectively, of resistance device 121, resistance device 124, impedance device 122, and impedance device 126, then the input impedance of termination circuit 114 is $$Zin = (R_1 \| Z_2) + (R_2 \| Z_1) = \frac{R_1 Z_2}{R_1 + Z_2} + \frac{R_2 Z_1}{R_2 + Z_1}.$$

$Z_{in}$ will equal $R_1$, independent of frequency, when $$R_1 = \frac{R_1 Z_2}{R_1 + Z_2} + \frac{R_2 Z_1}{R_2 + Z_1},$$

or $$R_1(R_1+Z_2)(R_2+Z_1)=R_1Z_2(R_2+Z_1)+R_2Z_1(R_1+Z_2).$$

This equation can then be rearranged to form $$Z_1 Z_2 = \frac{R_1^2(R_2 + Z_1) - R_1 R_2 Z_1}{R_2}.$$

The resistance of resistance device 121, $R_1$, is preferably substantially equal to the resistance of resistance device 124, $R_2$. In other words, $R_1=R_2=R$, in which case, $$Z_1Z_2=R^2+RZ_1-RZ_1,$$

and $$Z_1Z_2=R^2.$$

In termination 114, resistance device 121 is electrically in parallel with impedance device 126 and resistance device 124 is in parallel with impedance device 122. As discussed above, each pair of parallel-connected devices may be provided by a single device. For instance, a resistive stub or short, or even an active device, may have distributed capacitance or inductance. This parallel configuration is obtained with individual devices, as is illustrated in the figure, by a conductor 128 electrically connecting a junction 130 between devices 121 and 122 with a junction 132 between devices 124 and 126.

Impedance circuit 119 compensates for impedance circuit 120. With this configuration, when the resistances of the resistance devices are equal and the product of the impedances of the impedance devices equals the square of the resistance, then termination circuit 114 ideally has an impedance equal to the resistance of one resistance device for all frequencies.

Although the present invention has been described in detail with reference to a particular preferred embodiment, persons possessing ordinary skill in the art to which this invention pertains will appreciate that various modifications and enhancements may be made without departing from the spirit and scope of the claims as written and as judicially construed according to applicable principles of law. Thus, although described herein with reference to a microstrip transmission line, the present invention is applicable to other forms of transmission line, and may particularly be applied to coplanar embodiments using coplanar transmission lines, such as coplanar waveguides. Also, the preferred embodiment is a transmission line termination. The invention is also applicable to other applications, such as for providing compensation for active devices in a circuit. Terminations according to the invention may also be used on other microstrip termination applications. The general concepts may also be applied to other forms of terminations, such as those not involving vias. The above disclosure is thus intended for purposes of illustration and not limitation.

The invention claimed is:

1. A circuit having frequency-compensated impedance comprising:

first and second circuit terminals;

a first resistance device;

a first, inductive impedance device connected to the first resistance device, the series connection of the first resistance device and first impedance device connected to the first and second circuit terminals and providing a direct-current path between the first and second circuit terminals;

a second resistance device; and a second, capacitive impedance device connected to the second resistance device, the series connection of the second resistance device and the second impedance device also connected to the first and second circuit terminals, the first and second resistance devices and first and second impedance devices forming at least two parallel current paths between the first and second circuit terminals, the resistances of the first and second resistance devices being substantially equal, and the product of the impedances of the first and second impedance devices being substantially equal to the product of the resistances of the first and second resistance devices.

2. A circuit according to claim 1 wherein the magnitudes of the impedances of the first and second impedance devices are substantially equal to the resistances of the first and second resistance devices at a known frequency.

3. A circuit according to claim 1 for terminating a transmission line formed on an insulating substrate and including a strip signal conductor having the end on a first face of the substrate, and wherein at least the first resistance device, second resistance device and second impedance device are mounted on the first face of the substrate.

4. A circuit according to claim 3 wherein the second circuit terminal is a ground plane on a second face of the substrate opposite the first face, and the first impedance device comprises a via extending through the substrate between the first face of the substrate and the ground plane.

5. A circuit according to claim 4 wherein the second impedance device comprises an open-circuit stub on the first face of the substrate and having an end connected to the second resistance device.

6. A circuit according to claim 4 where the transmission line has a characteristic impedance, and wherein the resistances of the first and second resistance devices are substantially equal to the characteristic impedance.

7. A circuit according to claim 3 wherein the second impedance device includes a third impedance device on one side of the signal conductor and a fourth impedance device on the other side of the signal conductor, and the second resistance device includes a first resistor coupling the end of the signal conductor to the third impedance device and a second resistor coupling the end of the signal conductor to the fourth impedance device.

8. A circuit according to claim 7 wherein the first and second resistors have resistances substantially equal to twice the resistance of the first resistance device, and the impedances of the third and fourth impedance devices are substantially equal.

9. A circuit according to claim 8 wherein the second circuit terminal is a ground plane on a second face of the substrate opposite the first face, and wherein the first impedance device comprises a via extending through the substrate between the first face of the substrate and the ground plane, the third impedance device includes a first open-circuit stub and the fourth impedance device includes a second open-circuit stub.

10. A coupler formed on one side of an insulating substrate having opposite planar faces and a ground plane formed on the other face of the substrate comprising:

first, second, third and fourth ports; and signal coupling means coupling a signal between the first port and the second and third ports, including a circuit according to claim 1 coupling the fourth port to the ground plane.

11. A balanced amplifier comprising:

first, second, third, fourth, fifth and sixth signal lines;

an input coupler having first, second, third and fourth ports, the first, second and third signal lines coupled, respectively, to the first, second and third ports, and first signal coupling means coupling a signal received on the first signal line to the second and third signal lines, the input coupler including a first termination circuit coupling the fourth port to the ground plane;

first and second active devices coupling, respectively, the second signal line to the fourth signal line, and the third signal line to the fifth signal line; and an output coupler having fifth, sixth, seventh and eighth ports, the fourth, fifth and sixth signal lines coupled, respectively, to the fifth, sixth and seventh ports, and second signal coupling means coupling signals received on the fourth and fifth signal lines to the sixth signal line, the output coupler including a second termination circuit coupling the eighth port to the ground plane;

at least one of the input coupler and the output coupler comprising a coupler according to claim 10.

12. A circuit according to claim 1 wherein the first resistance device is connected in parallel with the second impedance device, and the second resistance device is connected in parallel with the first impedance device.

13. A circuit according to claim 1 wherein the first resistance device is connected in series with the first impedance device, and the second resistance device is connected in series with the second impedance device.

14. A circuit according to claim 1 for terminating a transmission line having a characteristic impedance, and wherein the resistances of the first and second resistance devices are substantially equal to the characteristic impedance.

15. A circuit according to claim 1 for terminating a transmission line having a characteristic impedance, and wherein the input impedance at the first terminal is substantially equal to an impedance different from the characteristic impedance at a known frequency, the circuit further comprising an impedance transformer coupling the transmission line to the first terminal for matching the impedance between the transmission line and the first terminal.

* * * * *